US006233420B1

(12) United States Patent
Liu et al.

(10) Patent No.: US 6,233,420 B1
(45) Date of Patent: May 15, 2001

(54) SYSTEM AND METHOD FOR ENHANCING LATENT IMAGE DEVELOPMENT

(75) Inventors: Chu-heng Liu, Penfield; Henry R. Till, East Rochester, both of NY (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/450,869

(22) Filed: Nov. 29, 1999

(51) Int. Cl.[7] ..... G03G 15/10
(52) U.S. Cl. ..... 399/237; 399/249
(58) Field of Search ..... 399/222, 57, 296, 399/233, 237, 279, 169; 347/124–126

(56) References Cited

U.S. PATENT DOCUMENTS 5,084,718 * 1/1992 Yamazaki et al. ..... 399/124
5,826,147 10/1998 Liu et al. ..... 399/237
5,937,243 * 8/1999 Lui et al. ..... 399/130
5,966,570 10/1999 Till et al. ..... 399/133
5,974,291 * 10/1999 Yamaguchi ..... 399/237
5,991,577 * 11/1999 Liu et al. ..... 399/169
6,020,099 * 2/2000 Liu et al. ..... 399/237 X
6,049,683 * 4/2000 Liu et al. ..... 399/237

* cited by examiner

*Primary Examiner*—Quana M. Grainger
(74) *Attorney, Agent, or Firm*—Lahine & Cockfield, LLP

(57) ABSTRACT

An imaging system and corresponding method for manipulating, regulating or adjusting the fluid concentration of a toner cake to enhance the resultant image quality, while concomitantly enhancing the development and separation of image portions of the toner cake from non-image or background portions of the toner cake. The imaging system includes a toner cake applicator for applying toner cake onto a toner cake receiving member, a charging device disposed so as to form an electrostatic latent image in the toner cake, a separation subsystem positioned relative to the receiving member so as to selectively separate at least a portion of the imaged toner cake from the receiving member, and a fluid regulating device for regulating the amount of fluid in the toner cake.

32 Claims, 2 Drawing Sheets

SYSTEM AND METHOD FOR ENHANCING LATENT IMAGE DEVELOPMENT

BACKGROUND OF THE INVENTION

The present invention relates generally to image reproducing systems, and more particularly relates to electrostatic latent image formation and development systems for enhancing latent image development.

Conventional electrostatographic copying and printing systems selectively charge and expose a photoreceptive member in an image-wise manner. This generates an input electrostatic latent image on the receiving member. The latent image is subsequently developed into a visible image by depositing charged development material on the surface of the receiving member. The developing material typically comprises carrier granules having marking or toner particles that electrically adhere to the latent image. The developed image is subsequently transferred, either directly or indirectly, from the receiving member to a copy substrate, such as paper or the like.

The above-described electrostatographic printing process is well known and has been implemented in various forms in the marketplace. Analogous processes also exist in other electrostatic printing applications, such as, for example, ionographic printing and reproduction where a charge is deposited in an image-wise configuration on a dielectric charge retentive surface, as well as in other electrostatic printing systems where a charge carrying medium is adapted to carry an electrostatic latent image.

In the foregoing electrostatographic printing processes, a development material, such as a toner cake, can be applied to the receiving member. The image quality in the printing process varies significantly due to numerous conditions affecting latent image formation on the toner cake as well as development of the image formed thereon. For example, the presence of excess fluid in the toner cake or the application of a relatively thick toner cake layer on the receiving member decreases image quality by exacerbating image "blooming" problems that are generally prevalent during copying. Moreover, the appropriate amount of fluid and the thickness of the toner cake necessary to promote relatively good image development is generally incompatible with the thickness and fluid content of the toner cake layer required for proper and adequate image separation and development.

An example of a prior ionographic image development system for creating a latent image in a toner layer on a support member is disclosed in U.S. Pat. No. 5,966,570, the contents of which are herein incorporated by reference. The system employs a charging device for directing a charge stream, which corresponds to the latent image, at the support member. The charge stream leads to image-wise charging of the toner layer, such that the toner layer becomes the latent image carrier. The toner layer is subsequently developed and transferred to a copy substrate.

An example of a prior image development system for creating a latent image in a toner layer on a support member is disclosed in U.S. Pat. No. 5,826,147, the contents of which are herein incorporated by reference. In this system, the support member is a photoreceptive member rather than a charge retentive member. Similar to the ionographic system, the present system can form a latent image in a layer of marking material on the photoreceptive member. A wide beam ion source is employed for directing free mobile ions at the support member. The latent image causes the free mobile ions to flow in an image-wise ion stream corresponding to the latent image. The ion stream leads to image-wise charging of the toner layer, such that the toner layer becomes the latent image carrier. The toner layer is subsequently developed and transferred to a copy substrate.

SUMMARY OF THE INVENTION

The present invention provides for an imaging system that employs structure, such as a fluid regulating device, to adjust the fluid content of a toner cake in order to reduce image blooming and enhance image quality and resolution. The fluid regulating device also adjusts the fluid content of the toner cake such that the fluid content of the toner cake is compatible with image separation and development, while concomitantly allowing the use of a thinner and more highly concentrated toner cake during the image formation process.

The imaging system of the present invention includes a toner cake applicator for applying toner cake onto a toner cake receiving member, a charging device disposed so as to form an electrostatic latent image in the toner cake, a separation subsystem positioned relative to the receiving member so as to selectively separate at least a portion of the imaged toner cake from the receiving member, and a fluid regulating device for regulating the amount of fluid in the toner cake.

According to one aspect, the fluid regulating device is adapted to adjust the amount of fluid present in the toner cake or in the separation subsystem so as to adjust the toner particle concentration in the toner cake. For example, the fluid regulating device is adapted to increase the concentration of toner particles in said toner cake by adjusting the amount of carrier fluid to promote or optimize the separation of the imaged toner cake from the receiving member.

According to another aspect, the toner cake applicator is adapted to apply a generally thin layer of toner cake to the receiving member. The toner cake has a selected concentration of toner particles for reducing image blooming. For example, the concentration of toner particles applied to the receiving member is higher than a concentration of toner particles employed to separate the imaged toner cake from the receiving member.

According to another aspect, the imaging system of the present invention further includes an imaging device positioned so as to apply an electrostatic latent image onto the receiving member prior to the application of the toner cake. The imaging device can include an image exposure station.

According to another aspect, the separation subsystem is adapted to receive at least a portion of the toner cake from the receiving member and for transferring at least a portion of the toner cake to a substrate. The separation subsystem includes an image bearing member for receiving a portion of the toner cake from the receiving member.

According to another aspect, the receiving member and the image bearing member are positioned relative to each other to form a nip therebetween for transferring at least a portion of the toner cake from the receiving member to the image bearing member. The fluid regulating device can be positioned to regulate the amount of fluid in the toner cake at the nip.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and, although not to scale, show relative dimensions.

DESCRIPTION OF ILLUSTRATED EMBODIMENTS

The present invention provides for a system and method for manipulating, regulating or adjusting a parameter or condition, such as fluid content, of the image forming process. In particular, the present invention provides for a system and method for manipulating, regulating or adjusting the fluid concentration of a toner cake to enhance the resultant image quality, while concomitantly enhancing the development and separation of image portions of the toner cake from non-image or background portions of the toner cake. The system of the present invention can be employed in a number of different types of image reproducing systems, examples of which include electrophotographic, electrostatic or electrostatographic, ionographic, and other types of image forming or reproducing systems that are adapted to capture and/or store image data associated with a particular object, such as a document. The system of the present invention is intended to be implemented in a variety of environments, such as in any of the foregoing types of image reproducing systems, and is not limited to the specific systems described below.

Figure 1:
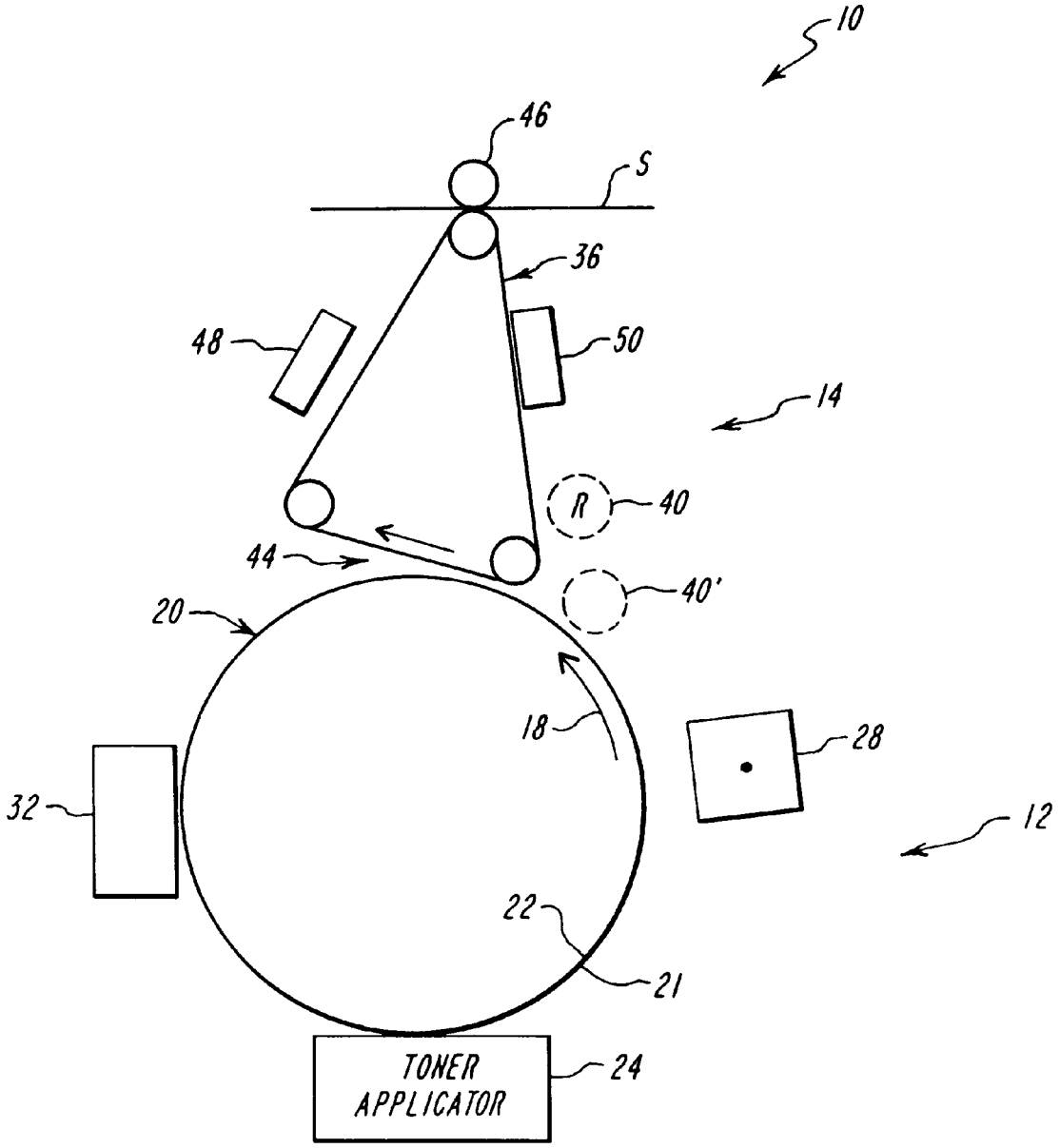
FIG. 1 is a schematic illustration of an image development and transfer system employing an ionographic subsystem and a fluid regulating device in accordance with the teachings of the present invention.

With reference to FIG. 1, the illustrated image development and transfer system 10 comprises an assemblage of operatively associated image forming elements for depositing an image onto a receiving member, developing the image, and then transferring the developed image onto a substrate. The system 10 includes an image formation subsystem or stage 12 and an image subsystem or stage 14. The entire system 10 or one or more of the subsystems 12 and 14 can form part of any conventional image reproducing system. According to one embodiment, the image formation subsystem 12 can be an ionographic reverse charge printing (RCP) subsystem. The illustrated image formation system 12 includes a receiving member 20 having an outer surface capable of receiving a layer of development material. An exemplary receiving member 20 can include a thin outer surface layer 21 composed of a conductive material, an insulative material, a dielectric material of the type known to those of ordinary skill in the art of ionography, a semiconductive material, or any other material suitable for use in electrostatographic imaging systems. The outer surface layer 21 of the receiving member 20 can be supported on an electrically conductive and preferably grounded support 22. Those of ordinary skill will readily recognize that various embodiments of the receiving member 20 can be employed consistent with the teachings of the present invention. For example, the image development and transfer system 10 can employ various types of receiving members well known in the art of electrostatographic printing including, but not limited to, a dielectric charge retaining member of the type generally used in ionographic printing machines.

The receiving member 20 is rotated by known means in a selected direction, such as in a counterclockwise process direction as illustrated by rotation arrow 18. The receiving member 20 is rotated so as to transport the outer surface layer 21 in a process direction for implementing a series of image forming steps in a manner similar to typical electrostatographic printing processes.

In the illustrated image formation subsystem 12, a substantially uniform layer of charged or uncharged development material (e.g., toner particles and a carrier liquid) can be deposited on the entire surface of the receiving member. In the illustrated embodiment, a toner applicator 24 houses a toner paste or cake that is applied by known processes to the outer surface layer 21 of the receiving member 20 to form a layer thereon. The toner cake can include toner particles carried in a suitable carrier medium. The toner cake within the reservoir can be applied to the receiving member 20 by an appropriate applicator (not shown), according to conventional roll coating methods, as well as other known processes and techniques.

The toner cake can be created in various ways. The toner cake can include charged or uncharged toner particles. In the case of a toner cake made up of charged toner particles, the charge can be placed on the toner particles while in the toner applicator 24, for example via ionic charge additives. Alternatively, the charge can be placed on the toner particles in the toner cake by any known ionic charging device, such as by charging device 28, as described in further detail below.

Depending on the materials utilized in the printing process, as well as other process parameters such as process speed and the like, the toner cake having sufficient thickness, preferably on the order of between 2 and 15 microns and more preferably between 3 and 8 microns, can be formed on the outer surface layer 21 of the receiving member 20 by merely providing adequate proximity and/or contact pressure between an applicator and the receiving member 20. Alternatively, in the case where the developing material comprises charged particles, electrical biasing may be employed to assist in actively moving the particles onto the outer surface layer 21 of the receiving member 20. Thus, according to one practice, an applicator roller mounted in the toner applicator 24 can be coupled to an electrical biasing source for implementing a so-called forward biasing scheme, wherein the applicator roller is provided with an electrical bias of sufficient magnitude to create electrical fields extending from the applicator roller to the outer surface 21 of the receiving member 20. These electrical fields cause toner particles to be transported to the surface 21 of the receiving member 20 for forming a substantially uniform layer of toner cake.

It will be understood that various other devices or apparatus can be utilized for applying toner cake to the receiving member 20, including various well known apparatus analogous to development devices used in conventional electrostatographic applications, such as, but not limited to, powder cloud systems which transport developing material through a gaseous medium such as air, brush systems which transport developing material to the toner layer support member by means of a brush or similar member, and cascade systems which transport developing material to the toner layer support member by means of a system for pouring or cascading the toner particles onto the surface of the receiving member. In addition, various systems directed toward the transportation of liquid developing material having toner particles immersed in a carrier liquid can be incorporated into the present invention. Examples of such liquid transport system can include a fountain-type device as disclosed generally in commonly assigned U.S. Pat. No. 5,519,473 (incorporated by reference herein), or any other system capable of causing the flow and transport of liquid developing material, including toner particles immersed in a liquid carrier medium, onto the surface of the receiving member 20. It is noted that, in the case of liquid developing materials, it is desirable that the toner cake formed on the outer surface 21 of the receiving member 20 can be in the range between about 15% and about 35% by weight toner solids, and preferably comprised of less than 20% by weight toner solids.

With respect to the foregoing toner cake formation process and various apparatus therefor, it will be understood that the toner cake generated on the receiving member 20 can be characterized as having a substantially uniform mass density per unit area. However, it is noted that some toner cake nonuniformity may be generated such that it is not a requirement of the present invention that the toner cake be uniform or even substantially uniformly distributed on the surface of the receiving member 20, so long as the toner layer covers, at a minimum, the desired image areas of the output image to be produced.

Referring again to FIG. 1, after the toner cake is deposited on the surface of the receiving member 20, the toner cake is charged in an image-wise manner by the charging device 28. The illustrated charging device 28, which can include a well known ionographic writing head/electron imaging beam, is arranged and adapted for producing and introducing free mobile ions into the toner cake disposed on the receiving member 20. The image-wise ion stream generated by the charging device 28 causes the toner particles in the toner cake to become selectively charged in an image-wise manner for generating an electrostatic latent image in the toner cake composed of toner particles having distinguishable charge levels in image and non-image (e.g. background) areas corresponding to the latent image.

When the latent image is placed on surface 21, which operates as a thin dielectric, then other devices can be used to move the latent image into the toner cake. Once the latent image (e.g., first or second latent image) is formed in the toner cake, the latent image bearing toner cake is advanced to the image subsystem 14.

The toner cake applied to the receiving member 20 by the toner applicator 24 has a dielectric thickness and toner concentration compatible with enhancing image quality and development. In particular, the toner cake thickness is sufficiently thin and has a toner concentration that minimizes blooming by reducing the repulsion force exerted by ions embedded in the toner cake by placing the charged ions in relatively close proximity with the receiving member 20, which functions as a ground plane. According to one practice, the image formation subsystem 12 initially applies toner cake on the receiving member 20 having a selected toner concentration that is higher than typically necessary for image development and separation. For instance, the toner cake can have a toner concentration in excess of 30% in order to sufficiently reduce blooming and therefore generate better image quality. According to another practice, the toner cake can include between about 20% and about 50% by weight solid material or particles. This toner concentration is higher than what is typically desirable for complete and proper image separation, which typically requires a toner concentration in the range between about 20% and about 30%. The illustrated system addresses this toner concentration incompatibility by regulating, manipulating, or adjusting the fluid content, and hence the toner concentration and viscosity, within the toner cake with the fluid regulating device 40. The illustrated fluid regulating device 40 regulates or adjusts the fluid constituent of the toner cake, such as by removing or adding fluid thereto, in order to regulate the toner concentration and viscosity to enhance image development and separation by the image transfer subsystem 14. The fluid regulating element can also directly or indirectly apply or remove a uniform or non-uniform amount of fluid to the toner cake, in a continuous or intermittent manner.

According to one embodiment, as illustrated in FIG. 1, the image subsystem 14 can employ an image separator provided in the form of an image bearing member 36 (e.g., belt) entrained about a set of rollers for receiving or separating the image from the toner cake disposed on the receiving member 20, and for transporting the image to the substrate S. The image bearing member 36 can be driven by any suitable driving device. The illustrated image bearing member 36 can be any transfer apparatus readily recognizable to those of ordinary skill in the art. For example, the image bearing member can be formed as a biased roll member. According to one practice, the fluid regulating device 40 can adjust or regulate the fluid content in the toner cake by dispensing fluid on the image bearing member 36 prior to contact with the image bearing toner cake at the development nip 44.

According to another practice, the fluid regulating device can be disposed at a different optional location, such as at the development nip 44, as illustrated by the optional fluid regulating device 40', so as to regulate the fluid content of the toner cake. The illustrated fluid regulating devices 40 and 40' can regulate the fluid content in the toner cake and hence the toner concentration and viscosity in order to promote clean image development and separation.

The fluid regulating device 40 can be any conventional fluid dispensing device suitable for dispensing a selected amount of liquid at a predetermined location, or for dispensing a selected amount of fluid, such as isopar, to a selected location. The fluid regulating device 40 can introduce a selected amount of liquid to the toner cake to decrease the toner concentration to a range more compatible or optimal for image development and separation. Conversely, if the toner concentration is below a desired level, liquid can be removed from the toner cake, directly or indirectly, in order to increase the toner concentration or fluid level to a more practical or desired range. Examples of suitable devices include liquid injection systems, blowers, slots, holes, blotters and squeegee rolls, and the like.

With further reference to FIG. 1, the image bearing member 36 of the image subsystem 14 facilitates development of at least a portion of the toner cake from the receiving member 20 to the image bearing member 36. The development of the toner cake between the subsystems 12 and 14 can be effected according to known and well characterized techniques. The image portions of the toner cake can be developed and transferred to the image bearing member 36 of the image subsystem 14. Meanwhile, the non-image or background portions of the image in the toner cake can remain on the receiving member 20.

The background portion of the image which remain in the toner cake can be removed from the receiving member 20 by any known technique, such as by the toner removal element 32. The illustrated toner removal element 32 can be any appropriate scraper or blade cleaning apparatus suitable for scraping the receiving member surface as is well known in the art. Alternative embodiments can include a brush or roller member for removing the toner cake from the surface on which it resides.

The developed image portion of the toner cake on the image bearing member 36 can then be transferred to the substrate S according to known and well characterized techniques. These techniques include employing a heated press roll arrangement 46 for pressure transferring and fixing the developed image from the image bearing member 36 to the substrate S. According to an alternate technique, an optional heating stage 48 can be employed to melt the toner image prior to transfer to the substrate S. Those of ordinary skill in the art will readily recognize that the heating stage 48 employs known techniques.

If the image is not completely transferred onto the copy substrate S, a cleaning device 50 can be employed to remove any residual toner cake that remains on the image bearing member 36.

A significant advantage of employing the fluid regulating device 40 of the present invention is that it optimizes, maximizes or enhances the benefits of the image formation subsystem 12 and the image subsystem 14, while concomitantly addressing, eliminating or reducing the incompatibilities between the two subsystems. Consequently, the illustrated image development and transfer system 10 produces better quality images (e.g., higher resolution images), promotes better separation of the image from the non-image portions of the toner cake, and optimizes or enhances the overall image development process. Another advantage is that the image formation subsystem 12 can employ a relatively dry and thin toner cake layer having a higher toner concentration at this initial stage, thereby reducing image blooming that typically occurs during this process. The higher toner concentration can subsequently be reduced to optimize or enhance image development and transfer by regulating or adjusting the fluid content in the toner cake with the fluid regulating device 40. The fluid can be regulated by adding fluid at any selected portion of the image forming process, or via any suitable system component. For example, fluid can be introduced to the image bearing member 36 for subsequent transfer to the toner cake at the development nip 44. Alternatively, fluid can be directly introduced into the development nip 44 to adjust or regulate the fluid content of the toner cake, and hence regulate the toner concentration and viscosity. Conversely, fluid can be removed from the toner cake in accord with system requirements in order to optimize, maximize, regulate, or adjust the toner concentration.

Those of ordinary skill will readily recognize that a conventional image reproducing system may employ a system controller for controlling one or more portions of the image forming process. In accordance with the present invention, the system controller can be employed to regulate the development and transfer of the image within and between the image development and image subsystems 12 and 14. Moreover, the system controller can be employed to control the operation of the fluid regulating device 40. According to one practice, the system controller can be employed in connection with one or more sensors in order to monitor the fluid level or content within the toner cake during the image forming process. For example, an optical sensor can also be employed to sense the density of the toner cake, and an optional thickness sensor can be employed to sense the total toner cake thickness. The information generated by the sensors can be employed in connection with the system controller to determine the amount of fluid that may need to be added or removed from the toner cake.

In operation, an input image which is desired to be copied to a copy substrate S is rendered in a system compatible format, such as in a digitized form, for subsequent transfer to the toner cake layer applied on a surface of the receiving member 20. The digital image data can be applied in an image-wise manner directly to the toner cake by the charging device 28. According to one practice, the image formation subsystem 12 can be constructed as an ionographic RCP system, and hence the charging device 28 can deposit free mobile ions into the toner cake. The image and non-image portions of the toner cake can then be separated at the development nip 44.

The fluid regulating device 40 of the present invention can be employed to adjust or regulate the fluid content of the toner cake such as by removing or adding fluid. The fluid regulating device 40 can be disposed at any suitable location in the illustrated image development and transfer system 10, and can be used in connection with either or both of the subsystems 12 and 14. According to one practice, the fluid regulating device 40 can be employed in connection with the image subsystem 14 to apply a fluid to the image bearing member 36 in order to regulate the fluid content in the toner cake. The fluid introduced to the toner cake reduces the toner concentration within the toner cake in order to optimize, enhance or promote subsequent image separation and transfer onto the substrate S. Moreover, the use of a dryer (higher toner concentration) and thinner toner cake layer on the receiving member during ionographic imaging prevents or reduces blooming, while concomitantly achieving higher image resolution. For example, the image formation subsystem 12 can employ a toner concentration level within the toner cake that is higher than the toner concentration range typically employed in the image subsystem 14 for a sufficiently complete and high quality image development. Those of ordinary skill will readily recognize that the toner concentration range within the image subsystem 14 is generally in the range between about 20–30%, and hence the toner concentration range of the toner cake employed in the image formation subsystem 12 can be higher, and can be significantly higher, than this range. Hence, the fluid introduced to the toner cake by the fluid regulating device 40 during the development of the toner cake from the receiving member 20 to the image bearing member 36, reduces the toner concentration to a level suitable for promoting, optimizing, or maximizing this image development.

Those of ordinary skill will also recognize that the fluid regulating device 40 can be disposed and employed at other locations within the image development and transfer system 10. According to an alternate practice, the fluid regulating device 40' can be employed in connection with the receiving member 20 to regulate or adjust the fluid content in the toner cake resident thereon. The fluid regulating device 40' can also be used to regulate the fluid content of the toner cake at the nip development 44, or at any other suitable location.

Once the toner cake is introduced to the development nip 44, the image portions of the toner cake are separated from the bulk toner cake resident on the receiving member, and are developed to the image bearing member 36. The non-image portions of the toner cake which remain on the receiving member 20 are removed therefrom by the toner removal element 32. The developed image portions of the toner cake on the image bearing member 36 are then heated and transferred to the substrate S. The image can be transferred to the substrate S by a heated press roller arrangement 46, which simultaneously applies pressure and heat to the image to transfer and fuse the image to the substrate S. Conversely, a heating stage 48 can be employed to heat and hence fix the image prior to transfer to the substrate S. Any portion of the image not transferred to the copy substrate S can be removed from the image bearing member 36 by the cleaning device 50.

Figure 2:
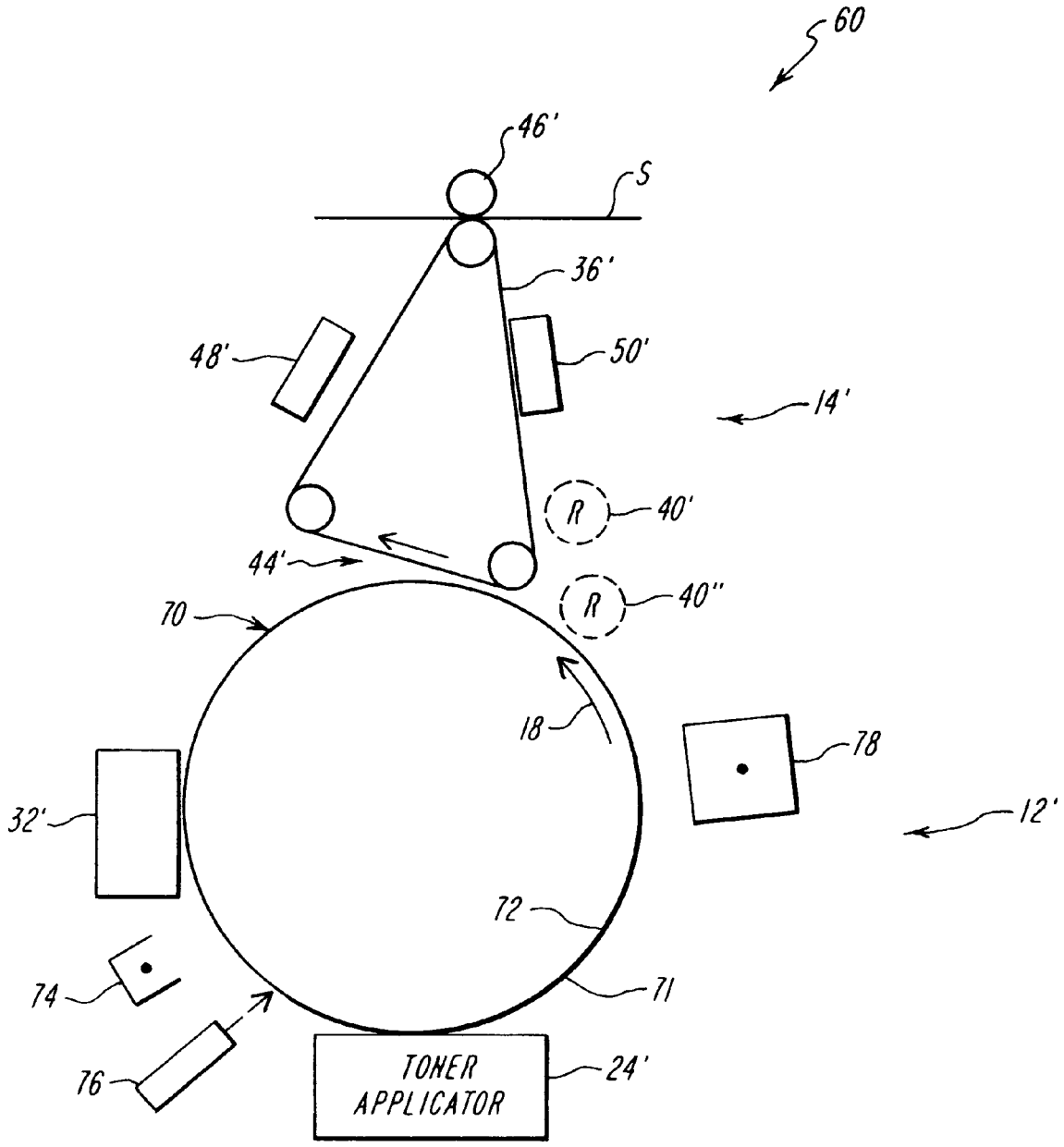
FIG. 2 is a schematic illustration of an alternate embodiment of the image development and transfer system of FIG. 1.

FIG. 2 illustrates an alternate embodiment of the image development and transfer system of FIG. 1. The system 60 illustrated in FIG. 2 is directed to a more conventional electrostatographic system that employs a photoconductive receiving member 70. Like parts are illustrated throughout the views with same reference numeral plus a superscript prime.

With reference to FIG. 2, the illustrated image development and transfer system 60 comprises an assemblage of operatively associated image forming elements for depositing an image onto a receiving member, developing the image, and then transferring the developed image onto a substrate. The system 60 includes an image formation subsystem or stage 12' and an image development subsystem or stage 14'. The system 60 or the subsystems 12' and 14' can form part of any conventional image reproducing system. The illustrated subsystem 12' includes a receiving member 70 that optionally includes a conventional photoconductor or photoreceptive surface component of the type known to those of ordinary skill in the art. As is known, the receiving member 20 can have a surface layer 71 having photoconductive properties, and can be supported by appropriate support assembly. Alternate forms of the receiving member 20 can also be used, and which would be obvious to those of ordinary skill. For example, although the system 60 incorporates a photoconductive imaging member, it will be well understood that the present invention contemplates the use of various other imaging members, such as non-photosensitive imaging members of the type used in ionographic systems, FIG. 1.

The receiving member 20 is rotated by known means in a selected direction, such as in a counterclockwise process direction as illustrated by rotation arrow 18. The receiving member 70 is rotated so as to transport a photoconductive surface thereof in a process direction for implementing a series of image forming steps in a manner similar to typical electrostatographic printing processes.

The surface of the receiving member 70 can pass by a charging device 74 for applying an electrostatic charge to the surface of the receiving member 70. The charging device 74 is provided for charging a photoconductive surface 71 of the receiving member 70 to a selected potential, such as a relatively high, substantially uniform potential. It will be understood that various charging devices, such as charge rollers, corona generating devices, charge brushes and the like, as well as induction and semiconductive charge devices among other devices which are well-known in the art, can be utilized as the charging device for applying a charge potential to the surface of the receiving member 20.

After the receiving member 70 is charged to a substantially uniform charge potential, the charged photoconductive surface 71 is advanced to an image exposure stage 76. The image exposure station 76 projects a light image corresponding to an input image onto the surface 71. As is well understood in the art, in the case of an imaging system having a photosensitive receiving member, the light image projected onto the surface 71 of the receiving member 70 selectively dissipates the charge thereon for recording an electrostatic latent image on the photoconductive surface. The electrostatic latent image comprises image areas defined by, for example, a first charge voltage, and non-image or background areas defined by, for example, a second charge voltage different from the first charge voltage. The charged image configuration corresponds to the input image informational areas. The image exposure station 76 may incorporate various optical image formation and projection components as are known in the art, and may also include various well known light lens apparatus or digital scanning systems for forming and projecting an image from an original input document onto the receiving member 20. The charge polarity of the image/non-image areas are known and well-characterized in the art.

In a typical electrostatographic printing process, the electrostatic latent image can be generated on the surface of the receiving member 70, if desired. The image can then be developed into a visible image by depositing thereon a developing material. In the illustrated embodiment, a toner applicator 24' houses a toner paste or cake that is applied to the entire surface 71 of the receiving member 70. Those of ordinary skill will readily recognize that the presence of the electrostatic latent image on the receiving member 70 can generate some fringe fields in areas of interface between image and non-image areas of the latent image. However, the effects of this field on the toner cake are minimal relative to the fields associated with conventional electrostatic latent image development such that, although some toner layer nonuniformity may result, the toner layer can be characterized as having a substantially uniform density per mass area in both image and non-image areas.

Referring again to FIG. 2, after the toner cake is deposited on the surface of the receiving member, the toner cake is charged in an image-wise manner by the recharging device 78. The illustrated recharging device 78, which can include a well known scorotron device, is arranged and adapted for introducing free mobile ions in the vicinity of the charged latent image, to facilitate the formation of an image-wise ion stream extending from the recharging device 78 to the latent image on the surface of the receiving member 70. The image-wise ion stream generated by the recharging device 78 generates a secondary latent image on the toner cake, and can be composed of oppositely charged toner particles disposed in an image configuration corresponding to the first or initial latent image generated on the receiving member 70. Those of ordinary skill will readily recognize that the system 10 can be constructed so as to form first and second latent images, such as a first latent image on the surface of the receiving member 70, and a second latent image on the toner cake. The use and formation of multiple latent images in an image forming system is set forth and described in the aforementioned U.S. Pat. No. 5,826,147, the teachings of which were previously incorporated by reference, and need not be described in greater detail herein.

Once the latent image (e.g., first or second latent image) is formed in the toner cake, the latent image bearing toner cake is advanced to the image subsystem 14'. According to one embodiment, as illustrated in FIG. 2, the image subsystem 14' can employ an image separator provided in the form of an image bearing member 36' (e.g., belt) entrained about a set of rollers for receiving or separating and developing the image from the toner cake disposed on the receiving member 20, and for transporting the image to the substrate S. According to one practice, the fluid regulating device 40' can adjust or regulate the fluid content in the toner cake by dispensing fluid on the image bearing member 36' prior to contact with the image bearing toner cake at the development nip 44'.

According to another practice, the fluid regulating device can be disposed at a different optional location, such as at the nip 44', as illustrated by the optional fluid regulating device 40", so as to regulate the fluid content of the toner cake. The illustrated fluid regulating devices 40' or 40" can regulate the fluid content in the toner cake in order to regulate or adjust the toner concentration and hence toner viscosity, in order to promote clean image development and separation.

With further reference to FIG. 2, the image bearing member 36' of the image subsystem 14' facilitates development of at least a portion of the toner cake from the receiving member 70 to the image bearing member 36'. The transfer of the toner cake between the subsystems 12' and 14' can be effected according to known and well characterized techniques. The image or non-image (e.g., background) portions of the toner cake can be development to the image bearing member 36' of the image subsystem 14'. Meanwhile, the non-image or background portions of the image in the toner cake remain on the receiving member 70.

The background portion of the image which remains in the toner cake can be removed from the receiving member 70 by any known technique, such as by the toner removal element 32'.

The image portion of the toner cake which is developed from the receiving member 70 to the image bearing member 36' can then be transferred to the substrate S according to known and well characterized techniques. These techniques include employing a heated press roll arrangement 46' for pressure transferring and fixing the developed image from the image bearing member 36' to the substrate S. According to an alternate technique, an optional heating stage 48' can be employed to melt the image prior to transfer to the substrate S. If the image is not completely transferred onto the copy substrate S, a cleaning device 50' can be employed to remove any residual toner cake that remains on the image bearing member 36.

A significant advantage of employing the fluid regulating device 40' of the present invention is that it optimizes, maximizes or enhances the benefits of the image-wise toner charging aspect of the image formation subsystem 12', and the development aspect occurring in the development nip 44' of the image subsystem 14', while concomitantly addressing, eliminating or reducing the incompatibilities between the two subsystems. Consequently, the illustrated image development and transfer system 60 produces better quality images (e.g., higher resolution images), promotes better separation of the image from the non-image portions of the toner cake, and optimizes or enhances the image development process. Another advantage for the ionographic embodiment of FIG. 1 is that the image formation subsystem 12' can use a toner cake having a higher toner concentration at this initial stage, thereby reducing image blooming that typically occurs during this process. The higher toner concentration can subsequently be reduced to optimize or enhance image development and transfer by adding or regulating or adjusting the fluid content in the toner cake via the fluid regulating device. The fluid can be regulated by adding fluid at any selected portion of the image forming process, or via any suitable system component. For example, fluid can be introduced to the image bearing member 36' for subsequent transfer to the toner cake. Alternatively, fluid can be introduced into the development nip 44' to adjust or regulate the fluid content of the toner cake, and hence regulate the toner concentration and viscosity. Conversely, fluid can be removed from the toner cake in accord with system requirements in order to optimize, maximize, regulate, or adjust the toner concentration.

Having described the invention, what is claimed as new and desired to be secured by Letters Patent is:

1. An imaging system, comprising a toner cake applicator for applying toner cake onto a toner cake receiving member, a charging device disposed so as to form an electrostatic latent image in the toner cake, a separation subsystem positioned relative to the receiving member for separating at least a portion of the imaged toner cake from the receiving member and for transferring the toner cake onto an image bearing member, and a fluid regulating device for regulating the amount of fluid in the toner cake.

2. The imaging system of claim 1, wherein said fluid regulating device is adapted to adjust the amount of fluid present in the toner cake.

3. The imaging system of claim 1, wherein said fluid regulating device is adapted to adjust the amount of fluid in the separation subsystem so as to adjust a concentration of toner particles in the toner cake.

4. The imaging system of claim 1, wherein said toner cake includes toner particles and a carrier fluid, and wherein said fluid regulating device is adapted to decrease the concentration of toner particles in said toner cake to promote the separation of said portion of said imaged toner cake.

5. The imaging system of claim 1, wherein said fluid regulating device is adapted to optimize the separation of said portion of said imaged toner cake.

6. The imaging system of claim 1, wherein said toner cake applicator is adapted to apply a generally thin layer of toner cake to the receiving member, said toner cake having a selected concentration of toner particles for reducing image blooming.

7. The imaging system of claim 6, wherein said concentration of said toner particles applied to the receiving member is higher than a concentration of toner particles in the toner cake at the separation subsystem so as to enhance the resolution of the image and said separation of said imaged toner cake from the receiving member.

8. The imaging system of claim 1, wherein said fluid regulating device is adapted to introduce a fluid directly or indirectly to said toner cake when disposed on the receiving member.

9. The imaging system of claim 1, wherein said fluid regulating device is adapted to remove fluid from said toner cake so as to promote said separation of said imaged toner cake from the receiving member.

10. The imaging system of claim 1, further comprising an imaging device positioned so as to apply an electrostatic latent image onto the receiving member.

11. The imaging system of claim 10, wherein said imaging device comprises an image exposure station.

12. The imaging system of claim 1, further comprising a second charging device for applying a uniform charge to the receiving member.

13. The imaging system of claim 1, wherein said image bearing member of said separation subsystem receives a portion of the toner cake from the receiving member and transfers said portion of the toner cake to a substrate.

14. The imaging system of claim 1, wherein said separation subsystem comprises means for developing at least a portion of the toner cake, and means for transferring and affixing the toner cake on a substrate.

15. The imaging system of claim 13, wherein the receiving member and said image bearing member are positioned relative to each other to form a nip therebetween for transferring at least a portion of the toner cake from the receiving member to the image bearing member, and wherein said fluid regulating device is positioned to regulate the amount of fluid in the toner cake at the nip.

16. The imaging system of claim 1, wherein said fluid regulating device is constructed so as to introduce a uniform or non-uniform amount of fluid to the toner cake.

17. An imaging system, comprising an electrostatic image formation subsystem for applying a toner cake on a receiving member and an electronic image on the toner cake, an image subsystem operatively coupled to the electrostatic image formation subsystem for receiving therefrom the image and for transferring the image to a substrate, and a fluid regulating device disposed relative to the electrostatic image formation subsystem and the image subsystem for regulating the amount of fluid in the toner cake so as to adjust a concentration of toner particles in the toner cake.

18. The imaging system of claim 17, wherein said electrostatic image formation subsystem comprises a toner cake applicator for applying a toner cake to the receiving member, and a charge source for generating an electrostatic image in the toner cake.

19. The imaging system of claim 18, wherein said electrostatic image formation subsystem further comprises an imaging device positioned so as to apply an electrostatic latent image onto the receiving member.

20. The imaging system of claim 19, wherein said imaging device comprises an image exposure station.

21. The imaging system of claim 19, further comprising a second charging device for applying a uniform charge to the receiving member.

22. The imaging system of claim 17, wherein said image subsystem comprises an image bearing member positioned to receive toner cake corresponding to the image, and for transferring the image to a copy substrate.

23. The imaging system of claim 17, wherein said fluid regulating device is adapted to add or remove fluid from the toner cake.

24. A method for regulating fluid in a toner cake employed in connection with an imaging system, said method comprising the steps of applying a toner cake on a receiving member, generating an electrostatic latent image in the toner cake on the receiving member, regulating the amount of fluid in the toner cake with a fluid regulating device, transferring at least a portion of the toner cake to an image bearing member, and transferring the image onto a substrate.

25. The method of claim 24, further comprising the step of separating and developing at least a portion of the imaged toner cake from the receiving member.

26. The method of claim 24, further comprising the step of applying an electrostatic latent image onto the receiving member.

27. The method of claim 24, further comprising the steps of affixing an image portion of the toner cake to the substrate.

28. The method of claim 27, wherein said step of regulating further comprises the step of adjusting the amount of fluid on the image bearing member or in the toner cake resident on the receiving member.

29. The method of claim 24, wherein said step of regulating further comprises the step of adjusting the amount of fluid present in the toner cake.

30. The method of claim 24, wherein said step of regulating further comprises the step of regulating the amount of fluid in the toner cake at a nip.

31. The method of claim 24 wherein the step of regulating further comprises the step of introducing a fluid to the toner cake.

32. The method of claim 24, wherein the step of regulating the amount of fluid in the toner cake comprises adjusting a concentration of toner particles in the toner cake.

* * * * *